US009797108B2

(12) United States Patent
Rodriguez

(10) Patent No.: US 9,797,108 B2
(45) Date of Patent: Oct. 24, 2017

(54) FREE DRAINING SEAL DEVICE AND INSTALLATION METHOD FOR MECHANICALLY STABILIZED EARTH WALL STRUCTURES

(71) Applicant: Joseph E. Rodriguez, Kissimmee, FL (US)

(72) Inventor: Joseph E. Rodriguez, Kissimmee, FL (US)

( * ) Notice: Subject to any disclaimer, the term of this patent is extended or adjusted under 35 U.S.C. 154(b) by 217 days.

(21) Appl. No.: 14/615,381

(22) Filed: Feb. 5, 2015

(65) Prior Publication Data

US 2015/0152617 A1 Jun. 4, 2015

Related U.S. Application Data

(63) Continuation of application No. 12/978,366, filed on Dec. 23, 2010, now abandoned.

(60) Provisional application No. 61/290,291, filed on Dec. 28, 2009.

(51) Int. Cl.

| | |
|---|---|
| ***E02B 11/00*** | (2006.01) |
| ***E02D 29/02*** | (2006.01) |
| ***E02D 5/10*** | (2006.01) |
| ***E02D 5/20*** | (2006.01) |

(52) U.S. Cl.

CPC ..... *E02B 11/00* (2013.01); *E02D 5/10* (2013.01); *E02D 5/20* (2013.01); *E02D 29/02* (2013.01); *E02D 29/0241* (2013.01)

(58) Field of Classification Search

CPC .. E02D 5/10; E02D 5/20; E02D 29/02; E02D 29/0241; E02D 29/0266; E02D 29/0283; E02B 1/00

See application file for complete search history.

(56) References Cited

U.S. PATENT DOCUMENTS

| | | | | | |
|---|---|---|---|---|---|
| 3,582,095 | A * | 6/1971 | Bogaert | B32B 27/00 | 277/654 |
| 4,045,965 | A * | 9/1977 | Vidal | E02D 29/0241 | 405/218 |
| 4,514,113 | A * | 4/1985 | Neumann | E02D 29/0233 | 405/262 |
| 4,616,959 | A * | 10/1986 | Hilfiker | E02D 29/0241 | 405/284 |
| 4,911,585 | A * | 3/1990 | Vidal | E02D 29/0283 | 405/284 |
| 5,190,413 | A * | 3/1993 | Carey | E02D 29/0266 | 405/262 |
| 6,447,211 | B1 * | 9/2002 | Scales | E02D 29/0241 | 405/262 |
| 6,827,527 | B2 * | 12/2004 | Conkel | E02D 29/025 | 405/262 |
| 6,854,231 | B2 * | 2/2005 | MacDonald | E02D 29/0283 | 405/284 |
| 7,726,084 | B2 * | 6/2010 | Sourlis | E04B 1/644 | 52/169.5 |

(Continued)

*Primary Examiner* — Thomas B Will
*Assistant Examiner* — Jessica H Lutz

(57) ABSTRACT

A mechanically stabilized earth (MSE) wall system that permits water drainage through joints while also preventing undesirable migration of backfill through joints, thus dramatically reducing or eliminating undesirable vegetation by incorporation of a free draining seal (FDS) in panel joints, wherein the FDS structure blocks backfill but permits water migration.

10 Claims, 6 Drawing Sheets

(56) References Cited

U.S. PATENT DOCUMENTS

2005/0155309 A1* 7/2005 Argila ..... E04B 1/70
52/596

* cited by examiner

FREE DRAINING SEAL DEVICE AND INSTALLATION METHOD FOR MECHANICALLY STABILIZED EARTH WALL STRUCTURES

CROSS-REFERENCE AND PRIORITY CLAIM TO RELATED APPLICATION

To the fullest extent permitted by law, the present U.S. Non-Provisional Patent Application is a continuation application of U.S. Non-Provisional patent application Ser. No. 12/978,366, filed on Dec. 23, 2010, currently pending, which claims priority to and the benefit of U.S. Provisional Patent Application No. 61/290,291, filed on Dec. 28, 2009, now abandoned, wherein all above-referenced applications are incorporated by reference herein in their entireties.

FIELD

The present disclosure relates generally to retaining wall construction comprised of mechanically stabilized earth (MSE) elements, and more particularly, to MSE structures with various facing elements for construction of earth retaining structures with improved joint systems for long term aesthetics and stability, wherein water drainage is allowed, yet backfill migration is prevented.

BACKGROUND

It is generally known that mechanically stabilized earth (MSE) is soil typically constructed with artificial reinforcing. It can be used for retaining walls, bridge abutments, dams, seawalls, and dikes, wherein reinforcing elements may vary, but generally include steel and geosynthetics to prevent erosion of soil. Although the basic principles of MSE have been used throughout history, MSE was developed in its current form in the 1960s.

Modern use of soil reinforcing for retaining wall construction was first pioneered by French architect and engineer Henri Vidal in the 1960s. The first MSE wall built in the United States was accomplished in 1971 on State Route 39 near Los Angeles. It is estimated that since 1997, many more than 23, 000 MSE walls have been constructed in the world.

As noted, the reinforcement materials of MSE can vary. Originally, long steel strips 50 to 120 mm (2 to 5 in) wide were used as reinforcement. These strips are sometimes ribbed, although not always, to provide added resistance. Sometimes steel grids or meshes are also used as reinforcement. Several types of geosynthetics can be used, including geogrids and geotextiles. The reinforcing geosynthetics can be made out of high density polyethylene, polyester, and polypropylene. These materials may also be ribbed and come in varying sizes and strengths. Generally, these geosynthetics are adhesively fastened to the backfill side of an MSE structure during construction, such as representatively depicted in FIGS. 8 and 9, wherein filter fabric strip F is shown, with adhesive glue G serving as fastener. As shown, bearing pad B even in combination with filter fabric strip F is unable to impede passage of fill through the joint, such that growth of undesirable vegetation V stems therefrom.

In other types of arrangements known in the art for reinforcement of MSE structures, rebar rods may be wrapped with the geotextile, wherein the rebar serves to structurally reinforce the MSE structure and the geotextile extension functions to limit movement of fill proximate the wall. Rebar rods positioned with in a MSE structural joint, however, inherently block the flow of water therethrough, disadvantageously enabling potentially damaging pressure build up.

By way of further background, and with reference to "Mechanically Stabilized Earth Wall Inspector's Handbook," State of Florida, Department of Transportation, Sep. 14, 2000, the disclosure of which is herein incorporated by reference in its entirety, established procedures are in place for the construction of a MSE wall system. For example, during preparation of a site, soil reinforcement and select backfill must be prepared for the MSE wall footprint area, including the zone of the wall facing. The foundation for the structure must be graded level for a width equal to or exceeding the length of soil reinforcement, or as shown in the plans. Any soft or loose material that is encountered should be stabilized. The wall system may comprise original ground, concrete leveling pad, wall facing panels, coping, soil reinforcement, select backfill, and any loads and surcharges. All of these foregoing items have an effect on the performance of the MSE wall and are taken into account in the stability analysis. A change in any of these items could have a detrimental effect on the wall.

Once the area has been properly prepared, a concrete leveling pad is typically poured in place. Coping is used to tie in the top of the wall panels and to provide a pleasing finish to the wall top. It can be cast-in-place or prefabricated segments. As noted and as representatively shown in FIGS. 8 and 9, filter fabric is typically used to cover the joint between panels, and is typically placed on the backside of the panels. This keeps the soil from being eroded through the joints and allows any excess water to flow out.

Random backfill may be allowed in normal embankment construction. Select backfill meeting the gradation, corrosion, unit weight, internal friction angle and any other requirements of the MSE structure specifications will typically be used. Soil reinforcement will be used to hold the wall facing panels in position and to provide reinforcement for the soil. As noted above, the soil reinforcement can be strips, grids, or mesh. The reinforcement can be made of steel (inextensible materials) or polymers (extensible materials). Wall panel spacers, or bearing pads B, are used and are typically ribbed elastomeric or polymeric pads inserted between the panels. The panels or panels are used to hold the soil in position at the face of the wall, and are typically concrete but they can be metal, wood, block, mesh or other material.

The subject matter of the present disclosure is intended to enhance these well-established practices, relevant to known MSE wall structures, wherein exemplary MSE wall structures known in the art frequently show undesirable vegetation, such as depicted in FIGS. 8-10. MSE walls are typically constructed with an inch joint spacing between precast concrete panels, commonly 5' square. The joints are typically covered with a strip of filter fabric F (+/−18") glued G to a back fill side of the panel with adhesive during construction, such as depicted in FIGS. 8 and 9. The filter fabric F allows water to pass through the joints, and limits some movement of back fill therethrough; nevertheless, the known use and installation of filter fabric F is disadvantageous in view of the present disclosure.

That is, it is readily apparent that there is a need for improved drainage systems that may be either initially or retroactively installed, and that allow water to drain through MSE structure joints while also effectively preventing backfill from migrating through the joints, thus eliminating or dramatically reducing the unwanted vegetation.

BRIEF SUMMARY

Briefly described, in a preferred embodiment, the present device overcomes the above-mentioned disadvantages and meets the recognized need by providing a device to replace or supplement the filter fabric of known MSE walls, that is, that maybe utilized in combination with known filter fabric installation methods and/or may be utilized to the exclusion of other fabric installations.

According to its major aspects and broadly stated, in its preferred form, for new construction, the presently described free draining seal (FDS) may replace the filter fabric and the construction adhesive on the backfill side of the panel and may be inserted in the panel joints, allowing water to pass through the joints but preventing the backfill from migrating through the joints with the water. The FDS may also be installed on the face side of the panels to prevent any grown of vegetation through the front face of the panels due to fill dirt that may make its way into the joint during construction.

More specifically, the device of the present disclosure in its preferred form is an elongate compressible core member surrounded by a filter fabric.

Existing MSE walls typically have the problem of vegetation growing through the joints of panels due to poor installation of the filter fabric, due to failure of the adhesive, due to fill that is inadvertently placed in the panel joints during construction, and/or due to vegetation growing from the finish grade up through the joints. The presently described FDS may be inserted into the joints (+/−½") to seal the joint from vegetation growing through the front, yet while allowing water to pass through the joints. Advantageously, the FDS does not require an adhesive to keep it in place during installation because of the compressible core. For retrofit, the FDS would be inserted after the existing vegetation has been removed.

Materials of construction for the presently described FDS, with its preferred compressible core with outer filtration layer, are preferably selected for performance characteristics, such as compressibility, porosity, and sustainability. For example, and without limitation, the compressible core backer is preferably open cell foam, and the fabric is preferably nonwoven filter fabric, such as polyester or polypropylene. Of course, any other natural or manmade materials may be utilized, either alone or in combination with other material(s), as long as the preferred performance characteristics are considered, and each is intended to be within the scope of the present disclosure.

The preferred FDS joint protection installation will essentially seal the panel joints from migration of backfill and prevent the growth of vegetation, while allowing the joints to provide free drainage, thereby preventing a build-up of hydrostatic pressure behind the wall panels.

The FDS may be used, for example, on high way projects, public works projects or commercial projects where precast panel facings are used on mechanically stabilized earth walls or similar applications, or in any other suitable installation wherein joint seal is desired for elimination of unwanted vegetative growth, but the flow of water or other liquid is desired to remain.

Accordingly, a feature and advantage of the present device is its ability to engage within the joints of a MSE structure without the use of adhesives.

Another feature and advantage of the present device is its ability to prevent the passage of particulate matter, for example fill dirt, into a joint of a MSE structure from a backfill side of the structure.

Yet another feature and advantage of the present device is its ability to prevent the passage of fill dirt from within a joint of a MSE structure to a face side of the structure.

Still another feature and advantage of the present device is its ability to allow the flow of water through a joint of a MSE structure, to and from a backfill side, from and to a face side.

Yet still another feature and advantage of the present device is its ability to be utilized alone or in combination with other MSE structural reinforcements or surface adaptations. Still yet another feature and advantage of the present device is its ability to be installed at the time of initial construction, or to be retrofit.

Yet another feature and advantage of the present device is its ability to conform to a variety of joint dimensions and configurations.

Still another feature and advantage of the present device is its ability to essentially eliminate unwanted vegetative growth proximate MSE structure joints.

Yet another feature and advantage of the present device is its ability to adapt for installation within an MSE structure, wherein targeted vegetative growth could be allowed in one or more joints, and wherein vegetative growth may be selectively prevented in one or more other joints, in order to define a growth pattern or design.

These and other features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATE EMBODIMENT(S)

The present device will now be described more fully hereinafter with reference to the accompanying drawings, in which embodiments of the present device are shown. The invention may, however, be embodied in many different forms and should not be construed as limited to the embodiments set forth herein. Rather, the embodiments herein presented are provided so that this disclosure will be thorough and complete, and will convey the scope of the invention to those skilled in the art. In describing the preferred and alternate embodiments of the present device, as illustrated in the figures and/or described herein, specific terminology is employed for the sake of clarity. The device, however, is not intended to be limited to the specific terminology so selected, and it is to be understood that each specific element includes all technical equivalents that operate in a similar manner to accomplish similar functions.

Figure 8:
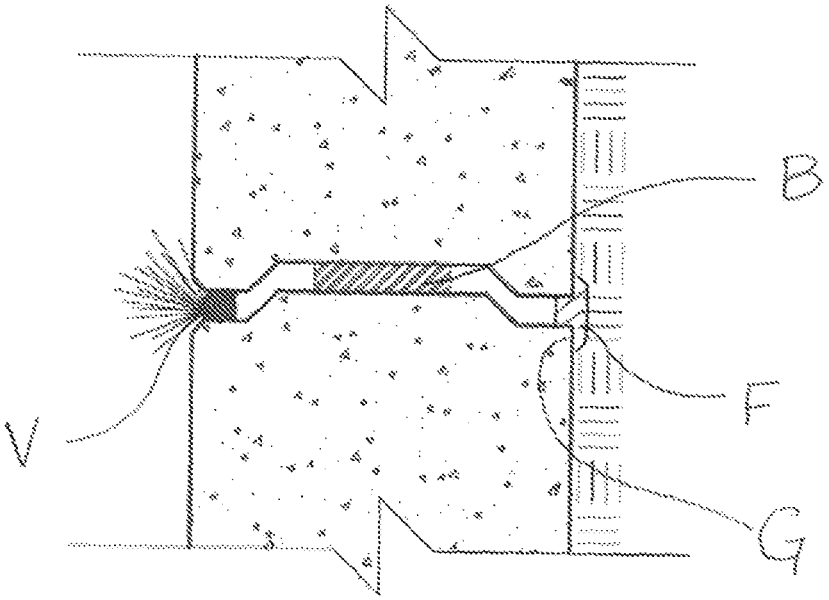
PRIOR ART FIGURE 8
FIG. 8 is a cross-sectional view of a prior art MSE wall system, showing undesirable vegetation, and further illustrated in the prior art wall system of FIG. 10, taken through lines 8-8.
Figure 9:
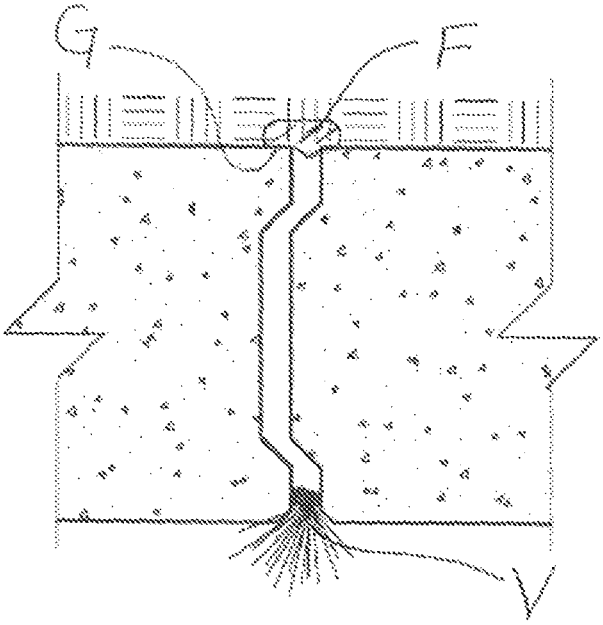
PRIOR ART FIGURE 9
FIG. 9 is a partial cross-sectional view of a vertical joint of a prior art MSE wall system, showing undesirable vegetation, and further illustrated in the prior art wall system of FIG. 10, taken through lines 9-9.
Figure 10:
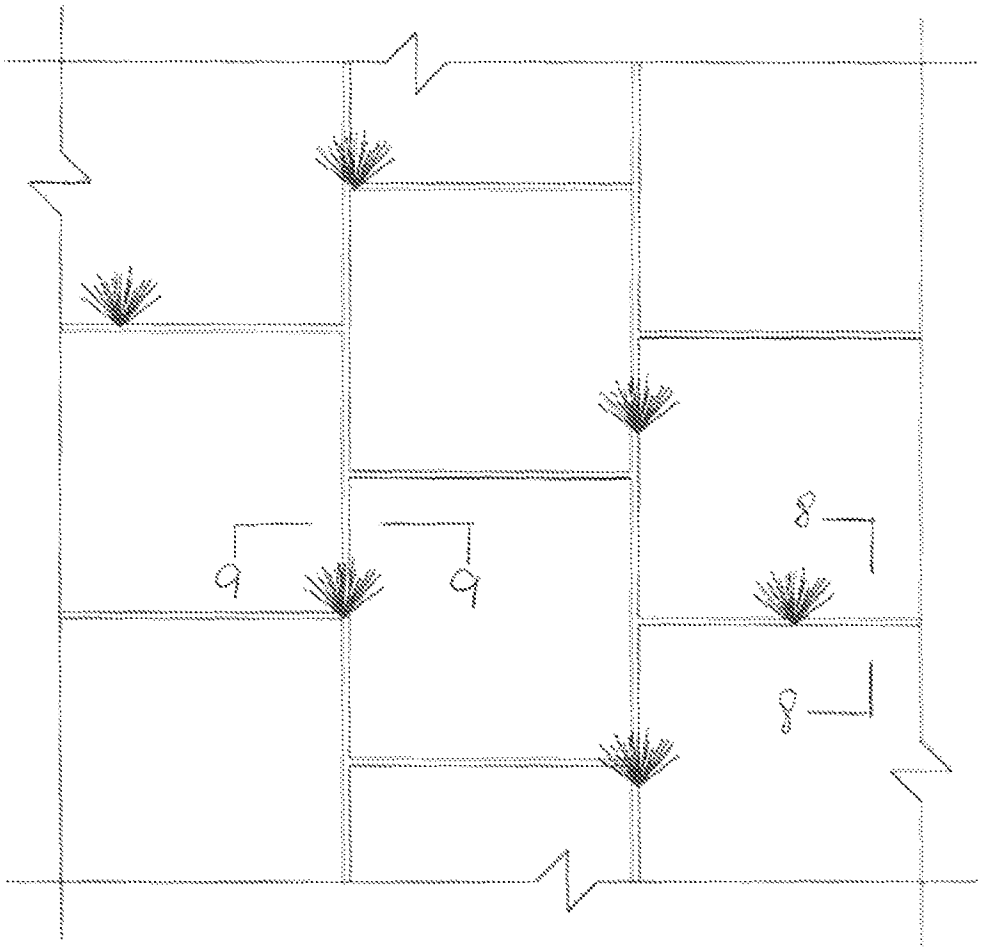
PRIOR ART FIGURE 10
FIG. 10 is a front face view of a prior art MSE wall system, showing undesirable vegetation.

As previously discussed, and referring initially to FIGS. 8-10, mechanically stabilized earth (MSE) walls are typically constructed with joints having a % inch joint spacing between opposing precast concrete panels. The joints are typically covered with a strip of filter fabric F (+/−18") glued to a back fill side of the panel with adhesive G during construction, as illustrated with reference to FIGS. 8 and 9. The filter fabric allows water to pass through the joints and seeks to inhibit the passage of backfill through the filter fabric. Free draining seal (FDS) 10 of the present disclosure is an improvement over the disadvantageous failures of placement and of function of such known filter fabric application, and of installation requirements related thereto.

One exemplary embodiment of the present device includes free draining seal (FDS) 10, as illustrated with reference to FIGS. 1 and 2, wherein FDS 10 may replace or supplement the filter fabric F illustrated and described, by way of example. FDS 10 is preferably defined by elongate member 12, wherein a plurality of layers 14 preferably form elongate member 12. According to the preferred embodiment, central layer 16 of FDS 10 is compressible core 18 and outer layer 20 is filtration medium 22.

Materials of construction for the presently described FDS 10 are preferably selected for characteristics such as compressibility, porosity, durable weatherability, or the like, wherein exposure to earthen components and environmental elements is expected to be endured, generally without compromise of functionality. For example, and without limitation, compressible core 18 of central layer 16 is preferably open cell foam, with a generally dense structure and functional porosity. Outer layer 20 is preferably polyethylene or polypropylene formed as a nonwoven fabric. Of course, any other natural or manmade material may be utilized, either alone or in combination with other material(s), as long as the preferred characteristics are considered, recognizing however that an FDS constructed with inferior materials, such as minimally compressible or minimally porous core material, but according to that structure as described herein, is intended to be within the scope of the present disclosure, even though realized functionality would be diminished.

According to the preferred embodiment, outer layer 20 may be extruded, needle punched, or otherwise formed. Although polyester and/or polypropylene are preferred, it should be recognized that it is the free draining nature of the material for outer layer 20 that is important. Nonwoven geotextile filter fabrics are particularly effective. Geotextiles may, for example, be selected from such source options as Carthage Mills, ADS, BP Amoco, Contech, Linq, Mirafi, Si, TNS, and/or Webtec, and may include, for example, monofilament filtration fabrics, woven slit film and high performance fabrics, and/or nonwoven fabrics.

One example is a nonwoven geotextile multipurpose fabric of polypropylene staple fibers, needle punched and heat set. For such a fabric, exemplary physical or dimensional properties, for example, are mass per unit area of 3 to 16 oz/yd2 and/or thickness of 40-165 mils. Exemplary hydraulics/filtration features are, for example, apparent opening size of 70-100 US Standard Sieve size, with no open area, permittivity of 2.0 to 0.70, permeability of 0.22-0.27 em/sec, and a flow rate of 150-50 gpm/ft2. UV resistance, a preferably feature of outer layer 20, maybe about 70% and mechanical properties, for example, may have grab tensile strength of 80-380 lbs, wide width tensile of 30-150 lbs/in, puncture of 50-240 lbs, and trapezoidal tear of 30-150 20 lbs. Of course, these properties are exemplary only, and should not be considered to limit available options for materials for formation of outer layer 20 of FDS 10.

Additionally, the preferred nonwoven fabric may be utilized in any selected thickness.

Figure 1:
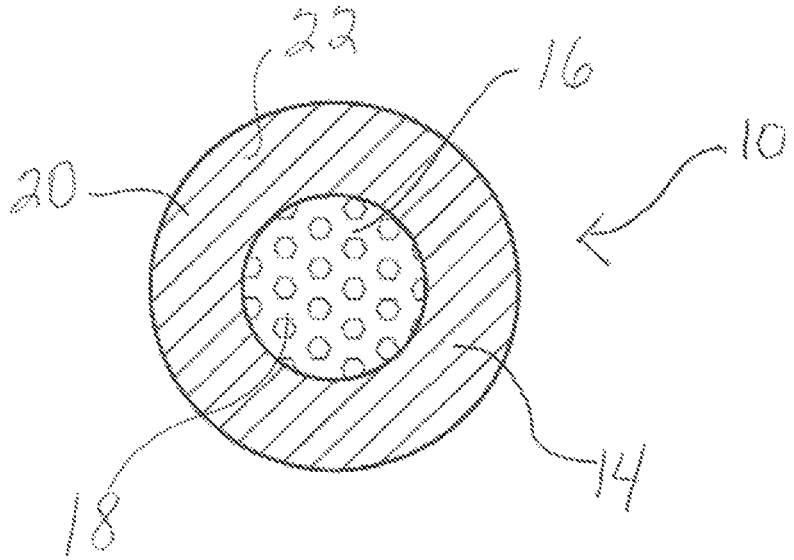
FIG. 1 is a cross-sectional view of a preferred embodiment of a free draining seal (FDS) according to the present disclosure.
Figure 2:
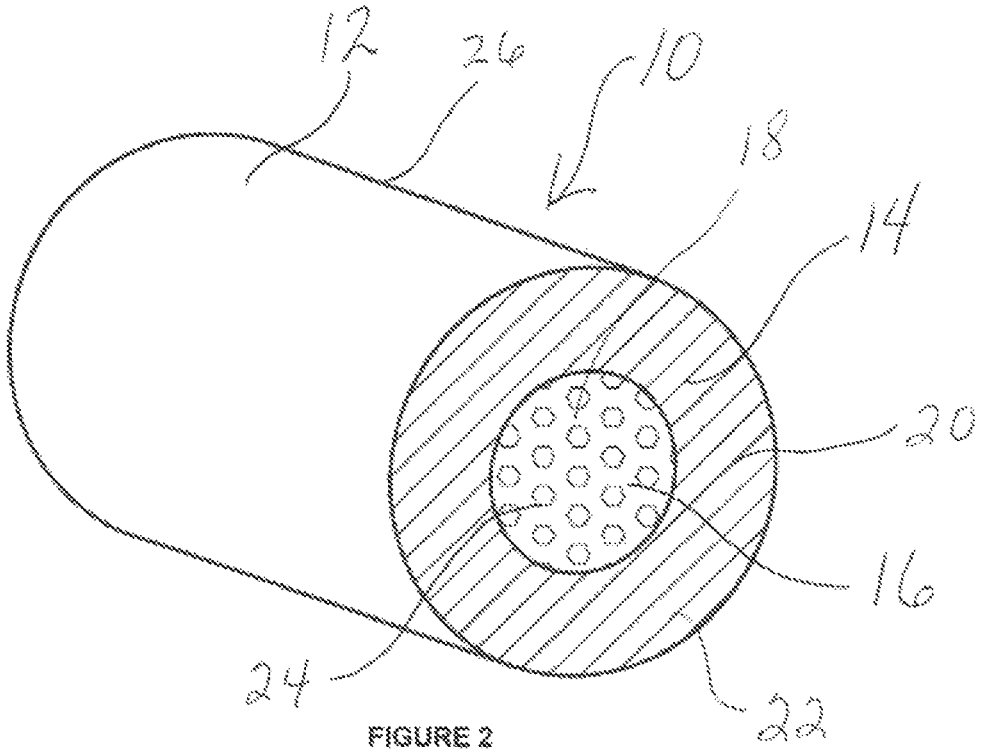
FIG. 2 is a perspective view of the FDS of FIG. 1.

Accordingly, it is important to note that the representative FDS 10 of FIGS. 1 and 2 is an exemplary depiction only, and should not be viewed as a limitation or necessary dimensional relationship of outer layer 20 and central layer 16. According to the preferred relative contribution of plurality of layers 14, central layer 16 is preferably a more principle component, with outer layer 20 preferably defining an essentially thin outer covering secured around an essentially thick central compressible core 18. Alternately, outer layer 20 may be comprised of a plurality of wrappings rather than a single wrapped layer, or outer layer 20 may be formed from a generally thick nonwoven filter fabric, such that even a single wrapped layer about central layer 16 is dimensionally significant.

Compressible core 18, also referred to as backer rod 24, may be provided in anyone of a variety of different diameters. The preferred diameter for compressible core 18 is preferably selected according to the targeted installation site, and the characteristics of the joint(s) to be "sealed" by FDS 10. Color of FDS 10, backer rod 24 and filtration medium 22 may also be selected according to the targeted installation site, wherein light colors may be more beneficially concealed proximate a light MSE structure and/or dark colors may be more camouflaged proximate a dark MSE structure.

Irrespective of color similarity or dissimilarity, outer layer 20 of FDS 10 is preferably securely attached to central layer 16. In the preferred embodiment, filtration medium 22 extends around the preferably cylindrical outer surface of backer rod 24 to define seam 26, wherein seam 26 is preferably adhesively bound. Alternately, seam 26 may be heat sealed, or otherwise securely positioned in place. In another alternate embodiment, filtration medium 22 could be extruded, in tubular form, such that no seam would be necessary along the length of FDS 10.

Other configurations and/or manners of forming FDS 10 may be employed, even wherein backer rod 24 and filtration medium 22 could be integrally formed as layers of a structurally holistic device.

Figure 3:
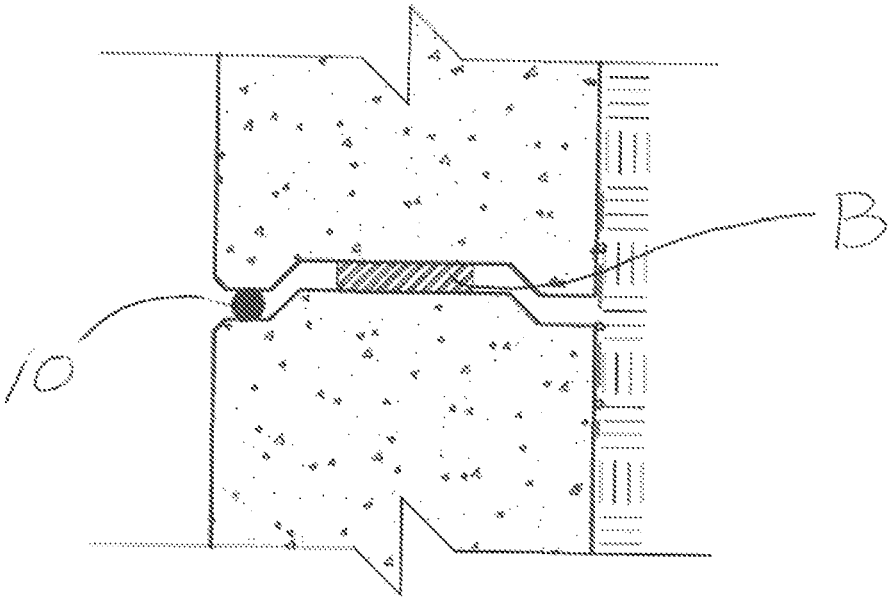
FIG. 3 is a partial cross-sectional view of a horizontal joint in keeping with the teachings of the present disclosure and further illustrated in a representative position in the wall system of FIG. 7, taken through lines 5-5.
Figure 4:
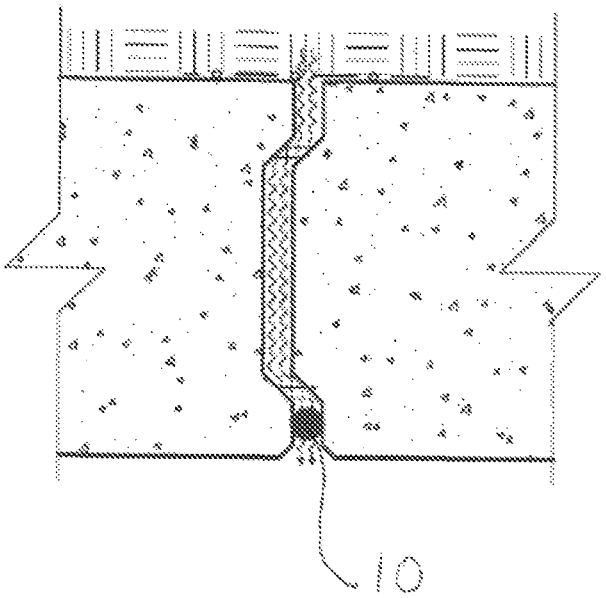
FIG. 4 is a partial cross-sectional view of a vertical joint in keeping with the teachings of the present disclosure and further illustrated in a representative position in the wall system of FIG. 7, taken through lines 6-6.
Figure 5:
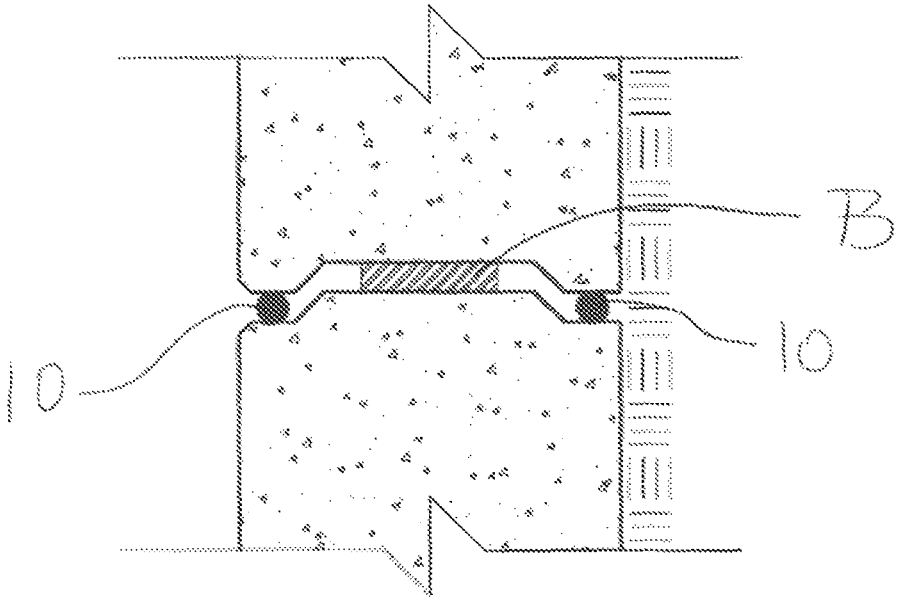
FIG. 5 is a partial cross-sectional view of a horizontal joint in keeping with the teachings of the present disclosure and further illustrated in the wall system of FIG. 7, taken through lines 5-5.
Figure 6:
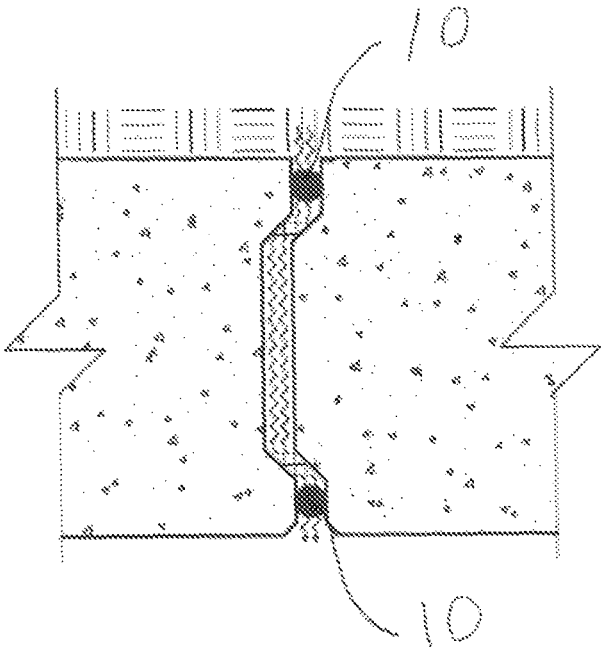
FIG. 6 is a partial cross-sectional view of a vertical joint in keeping with the teachings of the present disclosure and further illustrated in the wall system of FIG. 7, taken through lines 6-6.

In new construction, FDS 10 may replace both the filter fabric F and the construction adhesive G on the backfill side of the panel. As illustrated with reference to FIGS. 3-4, the FDS is inserted into the panel joints allowing water to pass through the joints but preventing the backfill from migrating through the joints with the water. With continued reference to FIGS. 5 and 6, the FDS may also be installed on the face side of the panels due to fill dirt that may make its way into the joint during construction.

Figure 7:
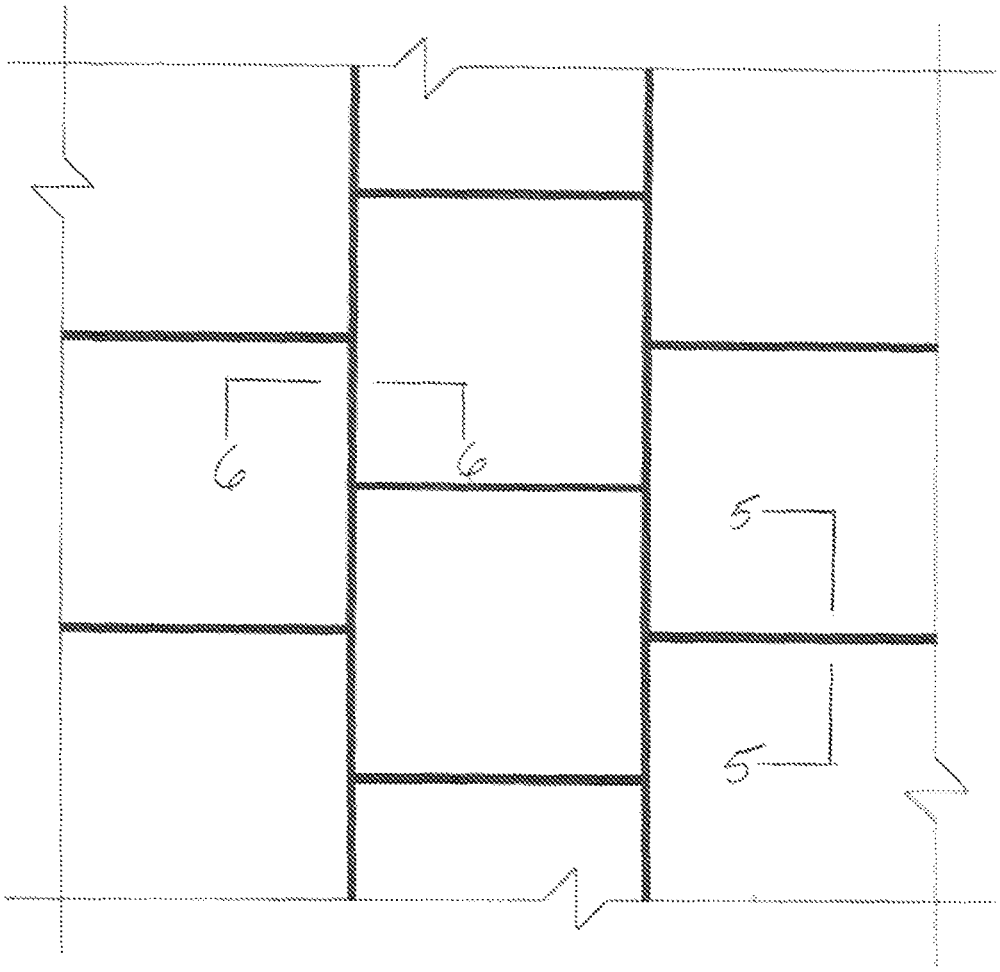
FIG. 7 is a partial diagrammatical front view of an improved mechanically stabilized earth wall system in keeping with the teachings of the present invention.

As above addressed, as representatively depicted in FIGS. 8-10, and as is well known in the art, typical MSE walls have undesirable vegetation V growing through the joints of panels (possibly due to poor installation of the filter fabric) from backfill that is inadvertently placed in the panel joints during construction, or from vegetation growing from the finish grade up through the joints. FDS 10 of the present disclosure may be inserted in the joints (+/−½") to seal the joint from vegetation V growing through the front joints, but will allow water to pass through the joints. By way of example, and with reference to FIG. 7, FDS 10 would be inserted after the existing vegetation has been removed, and desirably does not require an adhesive to keep it in place during installation because of the nature of compressible core 18.

Having thus described exemplary embodiments of the present invention, it should be noted by those skilled in the art that the within disclosures are exemplary only, and that various other alternatives, adaptations, and modifications may be made within the scope of the present invention. Many modifications and other embodiments of the device will come to the mind of one skilled in the art having the benefit of the teachings presented in the present description and the associated drawings. Accordingly, the present invention is not limited to the specific embodiments illustrated herein, but is limited only by the following claims.

What is claimed as new and what is desired to secure by Letters Patent of the United States is:

1. A combination concrete barrier and free draining seal system, comprising:

a mechanically stabilized earth (MSE) wall including a first precast concrete panel, a second precast concrete panel locate next to said first precast concrete panel, and a joint spacing located between said first precast concrete panel and said second precast concrete panel; and a free draining seal interfitted within said joint spacing thereby allowing water to pass through said joint spacing while inhibiting particulate matter to pass therethrough;

wherein said free draining seal comprises a central layer including an elongate compressible core member, and an outer layer completely wrapped about said central layer, said outer layer including a filtration layer, said filtration layer encircling said elongate compressible core member and secured relative thereto;

wherein each of said central layer and said outer layer is interfitted within said joint spacing between said first precast concrete panel and said second precast concrete panel of said MSE wall.

2. The combination concrete barrier and free draining seal system of claim 1, further comprising:

a filter fabric and an adhesive applied between said filter fabric and said MSE wall such that said filter fabric is secured proximate to said joint spacing.

3. The combination concrete barrier and free draining seal system of claim 2, wherein said joint spacing of said MSE wall is on a face side of said first precast concrete panel and said second precast concrete panel of said MSE wall.

4. The combination concrete barrier and free draining seal system of claim 3, wherein said joint spacing of said MSE wall is on a backfill side of said first precast concrete panel and said second precast concrete panel of said MSE wall.

5. The combination concrete barrier and free draining seal system of claim 1, wherein each of said central layer and said outer layer has a circular cross-section for evenly filtering fluid therethrough while preventing debris from passing therethrough.

6. The combination concrete barrier and free draining seal system of claim 5, wherein said elongate compressible core member is further comprised of open cell foam.

7. The combination concrete barrier and free draining seal system of claim 5, wherein said filtration layer is further comprised of a nonwoven filter fabric.

8. The combination concrete barrier and free draining seal system of claim 7, wherein said nonwoven filter fabric is selected from the group consisting of polyester, polypropylene, and a synthetic polymer blend.

9. The combination concrete barrier and free draining seal system of claim 1, wherein said filtration layer is one of adhesively bonded and heat sealed to said core member.

10. A combination concrete barrier and free draining seal system, comprising:

a mechanically stabilized earth (MSE) wall including a first precast concrete panel, a second precast concrete panel locate next to said first precast concrete panel, and a joint spacing intermediately located between said first precast concrete panel and said second precast concrete panel, said joint spacing being curvilinear and spanning across a corresponding major length of each said first precast concrete panel and said second precast concrete panel; and a free draining seal interfitted within said joint spacing thereby allowing water to pass through said joint spacing while inhibiting particulate matter to pass therethrough;

a filter fabric and an adhesive applied between said filter fabric and said MSE wall such that said filter fabric is secured exterior of said joint spacing and spaced from said free draining seal;

wherein said joint spacing of said MSE wall is on a face side of said first precast concrete panel and said second precast concrete panel of said MSE wall;

wherein said joint spacing of said MSE wall is on a backfill side of said first precast concrete panel and said second precast concrete panel of said MSE wall;

wherein said free draining seal comprises a central layer including an elongate compressible core member, and an outer layer completely wrapped about said central layer, said outer layer including a filtration layer, said filtration layer encircling said elongate compressible core member and secured relative thereto;

wherein each of said central layer and said outer layer is interfitted within said joint spacing between said first precast concrete panel and said second precast concrete panel of said MSE wall.

* * * * *